US009996042B2

(12) United States Patent
Fujiwara et al.

(10) Patent No.: US 9,996,042 B2
(45) Date of Patent: Jun. 12, 2018

(54) IMAGE FORMING APPARATUS

(71) Applicant: KONICA MINOLTA, INC., Chiyoda-ku, Tokyo (JP)

(72) Inventors: Takashi Fujiwara, Tokyo (JP); Jun Onishi, Tokyo (JP); Masahito Takano, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days. days.

(21) Appl. No.: 15/054,577

(22) Filed: Feb. 26, 2016

(65) Prior Publication Data

US 2016/0259284 A1 Sep. 8, 2016

(30) Foreign Application Priority Data

Mar. 2, 2015 (JP) ..... 2015-040035

(51) Int. Cl.
*G03G 15/16* (2006.01)
*G03G 15/00* (2006.01)

(52) U.S. Cl.
CPC ..... *G03G 15/6558* (2013.01); *G03G 15/1605* (2013.01); *G03G 15/5008* (2013.01); *G03G 15/6594* (2013.01); *G03G 2215/00481* (2013.01); *G03G 2215/0132* (2013.01)

(58) Field of Classification Search
None
See application file for complete search history.

(56) References Cited

U.S. PATENT DOCUMENTS

2005/0286916 A1 12/2005 Nakazato et al.
2009/0060613 A1 3/2009 Matsuda et al.
2009/0207461 A1* 8/2009 Hodoshima ..... G03G 15/5029 358/498
2011/0129263 A1* 6/2011 Nagao ..... G03G 15/1605 399/302
2016/0202648 A1* 7/2016 Takada ..... G03G 15/2039 399/67

FOREIGN PATENT DOCUMENTS

JP 60-101568 A 6/1985
JP 2001-166620 A 6/2001
JP 2005-241864 A 9/2005
JP 2006-11174 A 1/2006
JP 2006-276500 A 10/2006
(Continued)

OTHER PUBLICATIONS

JP 2001166620 English machine translation, Yamashita et al., Jun. 22, 2001.*

(Continued)

*Primary Examiner* — Thomas Giampaolo, II
(74) *Attorney, Agent, or Firm* — Buchanan Ingersoll & Rooney PC

(57) ABSTRACT

An image forming apparatus includes: a first roller having an elastic part; a second roller configured to form a nip between the first roller and the second roller; a holding member configured to hold the second roller; and a control section configured to control the position of the holding member such that the center distance between the first roller and the second roller is maintained at a constant value when a sheet passes through the nip.

12 Claims, 10 Drawing Sheets

(56) References Cited

FOREIGN PATENT DOCUMENTS

| | | | |
|---|---|---|---|
| JP | 2007-127759 | A | 5/2007 |
| JP | 2009-058604 | A | 3/2009 |
| JP | 2009-198596 | A | 9/2009 |
| JP | 2011-112913 | A | 6/2011 |
| JP | 2012-42755 | A | 3/2012 |
| JP | 2013-195875 | A | 9/2013 |
| JP | 2014-081607 | A | 5/2014 |

OTHER PUBLICATIONS

Japanese Office Action ("Notice of Reasons for Rejection") dated May 9, 2017, by the Japanese Patent Office in corresponding Japanese Patent Application No. 2015-040035 and English translation of the Office Action (13 pages).

Office Action (Notice of Reasons for Rejection) dated Nov. 7, 2017, by the Japanese Patent Office in corresponding Japanese Patent Application No. 2015-040035, and an English Translation of the Office Action. (14 pages).

Office Action (Decision of Rejection) dated Mar. 6, 2018, by the Japanese Patent Office in corresponding Japanese Patent Application No. 2015-040035, and an English Translation of the Office Action (10 pages).

* cited by examiner

IMAGE FORMING APPARATUS

CROSS REFERENCE TO RELATED APPLICATIONS

This application is entitled to and claims the benefit of Japanese Patent Application No. 2015-040035, filed on Mar. 2, 2015, the disclosure of which including the specification, drawings and abstract is incorporated herein by reference in its entirety.

BACKGROUND OF THE INVENTION

1. Field of the Invention

The present invention relates to an image forming apparatus.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet, and then heat and pressure are applied to the sheet at a fixing nip to form a toner image on the sheet.

Conventionally, in the above-mentioned image forming apparatus, when thick paper having a relatively large thickness is used as a sheet, linear density unevenness that is called shock jitter has been caused in some cases. Such density unevenness is caused when the on the driving source of an image bearing member is abruptly increased and the surface movement velocity of the image bearing member is largely and momentarily increased at the time when thick paper enters a transfer position (for example, a secondary transfer nip) where the image bearing member (for example, an intermediate transfer belt) that rotates while bearing a toner image and a transfer member (for example, a secondary transfer roller) that rotates while making contact with the image bearing member and transfers the toner image formed on the surface of the image bearing member to a sheet make contact with each other.

Japanese Patent Application Laid-Open No. 2009-198596 discloses a technique for reducing shock jitter and transfer defect which can be caused when the distance between the surface of the intermediate transfer belt and the rotational axis of the secondary transfer roller falls outside a proper distance due to the change of the diameter and the elastic modulus of the secondary transfer roller. In the technique disclosed in Japanese Patent Application Laid-Open No. 2009-198596, a thickness sensor configured to detect the thickness of a sheet (recording sheet) and a distance sensor configured to detect the position of the secondary transfer roller are provided, and the position of the secondary transfer roller in the state where an eccentric cam is in contact with a swing arm is adjusted on the basis of a detection result obtained by the thickness sensor and a detection result obtained by the distance sensor in the state where the eccentric cam is not in contact with the swing arm configured to hold the secondary transfer roller in a swingable manner.

The technique disclosed in Japanese Patent Application Laid-Open No. 2009-198596 includes a mechanism configured to form a secondary transfer nip effective for suppressing shock jitter by controlling the center distance between the secondary transfer roller and a transfer counter roller that faces the secondary transfer roller with the intermediate transfer belt therebetween in accordance with the thickness of the sheet. To be more specific, the secondary transfer roller in synchronization with the swing member is brought into contact with the transfer counter roller with the spring load of a pressing spring, and a stabilized position (that is, a position where an appropriate transfer nip pressure is obtained) is set as a reference position, and, the swing member is pushed down by the eccentric cam by a distance corresponding to the thickness of the sheet while utilizing a result of detection of the distance sensor. In such a mechanism, the secondary transfer nip is formed with the spring load, and therefore, for the purpose of minimizing the variation of the spring load due to displacement of the pressing spring at the time of entering and leaving of the sheet (at the time when the sheet enters the secondary transfer nip, and when the sheet leaves the secondary transfer nip), the elasticity coefficient of the pressing spring (difficulty of deformation) is set to a significantly small value. However, in the case where the secondary transfer roller is composed of a roller having a certain mass such as a hard roller for example, the position of the secondary transfer roller is displaced at the time of entering and leaving of the sheet, and acceleration is generated at the secondary transfer roller. As such, the above-mentioned mechanism in which the pressing spring has a significantly small elasticity coefficient behaves as if the secondary transfer roller bounds. As a result, the load on the driving source of the intermediate transfer belt may be abruptly increased, and the surface movement velocity of the intermediate transfer belt may be momentarily reduced, thus generating shock jitter.

SUMMARY OF THE INVENTION

An object of the present invention is to provide an image forming apparatus which can suppress generation of shock jitter.

To achieve the abovementioned object, an image forming apparatus reflecting one aspect of the present invention includes: a first roller having an elastic part; a second roller configured to form a nip between the first roller and the second roller; a holding member configured to hold the second roller; and a control section configured to control a position of the holding member such that a center distance between the first roller and the second roller is maintained at a constant value when a sheet passes through the nip.

Desirably, the image forming apparatus further includes a driving section configured to move the holding member between a separation position at which the second roller held by the holding member is separated from the first roller, and a pressing position at which the second roller presses the first roller such that the elastic part of the first roller is depressed by a predetermined depression amount after the first roller and the second roller start to make contact with each other, wherein the control section controls the driving section to control the position of the holding member.

Desirably, in the image forming apparatus, the control section sets the depression amount in accordance with a type of the sheet.

Desirably, the image forming apparatus further includes a contact timing detection section configured to detect a contact timing at which the first roller and the second roller start to make contact with each other.

Desirably, in the image forming apparatus, the contact timing detection section includes: a light emission section provided on one of an upstream side and a downstream side of the nip in a sheet conveyance direction, and configured to emit light toward the other one of the upstream side and the downstream side; and a light reception section provided on the other one of the upstream side and the downstream side of the nip in the sheet conveyance direction, and configured to receive light emitted from the light emission section, and the contact timing detection section detects the contact timing on a basis of a result of light reception of the light reception section.

Desirably, in the image forming apparatus, the contact timing detection section includes: an air outputting section provided on one of an upstream side and a downstream side of the nip in a sheet conveyance direction, and configured to output air toward the other one of the upstream side and the downstream side; and an air flow detection section provided on the other one of the upstream side and the downstream side of the nip in the sheet conveyance direction, and configured to detect a flow rate of air output from the air outputting section, and the contact timing detection section detects the contact timing on a basis of a result of detection of the air flow detection section.

Desirably, in the image forming apparatus, the air outputting section and the air flow detection section are provided on one side and the other side, respectively, in an axis direction of the first roller and the second roller.

Desirably, in the image forming apparatus, the contact timing detection section includes: a sound generation section provided on one of an upstream side and a downstream side of the nip in a sheet conveyance direction, and configured to generate sound toward the other one of the upstream side and the downstream side; and a sound detection section provided on the other one of the upstream side and the downstream side of the nip in the sheet conveyance direction, and configured to detect the sound generated by the sound generation section, and the contact timing detection section detects the contact timing on a basis of a result of detection of the sound detection section.

Desirably, in the image forming apparatus, the sound generation section and the sound detection section are provided on one side and the other side, respectively, in an axis direction of the first roller and the second roller.

Desirably, in the image forming apparatus, the contact timing detection section includes: a vibration generation section configured to generate forced vibration at one of the first roller and the second roller; and a vibration detection section configured to detect the forced vibration which is generated by the vibration generation section and propagated to the other one of the first roller and the second roller through contact between the first roller and the second roller, and the contact timing detection section detects the contact timing on a basis of a result of detection of the vibration detection section.

Desirably, in the image forming apparatus, the vibration generation section generates vibration having a frequency which does not affect an image formation process.

Desirably, in the image forming apparatus, the contact timing detection section includes: a rotation noise generation section configured to generate rotation noise at one of the first roller and the second roller; and a rotation noise detection section configured to detect the rotation noise which is generated by the rotation noise generation section and propagated to the other one of the first roller and the second roller through contact between the first roller and the second roller, and the contact timing detection section detects the contact timing on a basis of a result of detection of the rotation noise detection section.

Desirably, in the image forming apparatus, the rotation noise generation section generates rotation noise having a frequency which does not affect an image formation process.

Desirably, in the image forming apparatus, the elastic part has a hardness of 80° or smaller in ASKER C hardness.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
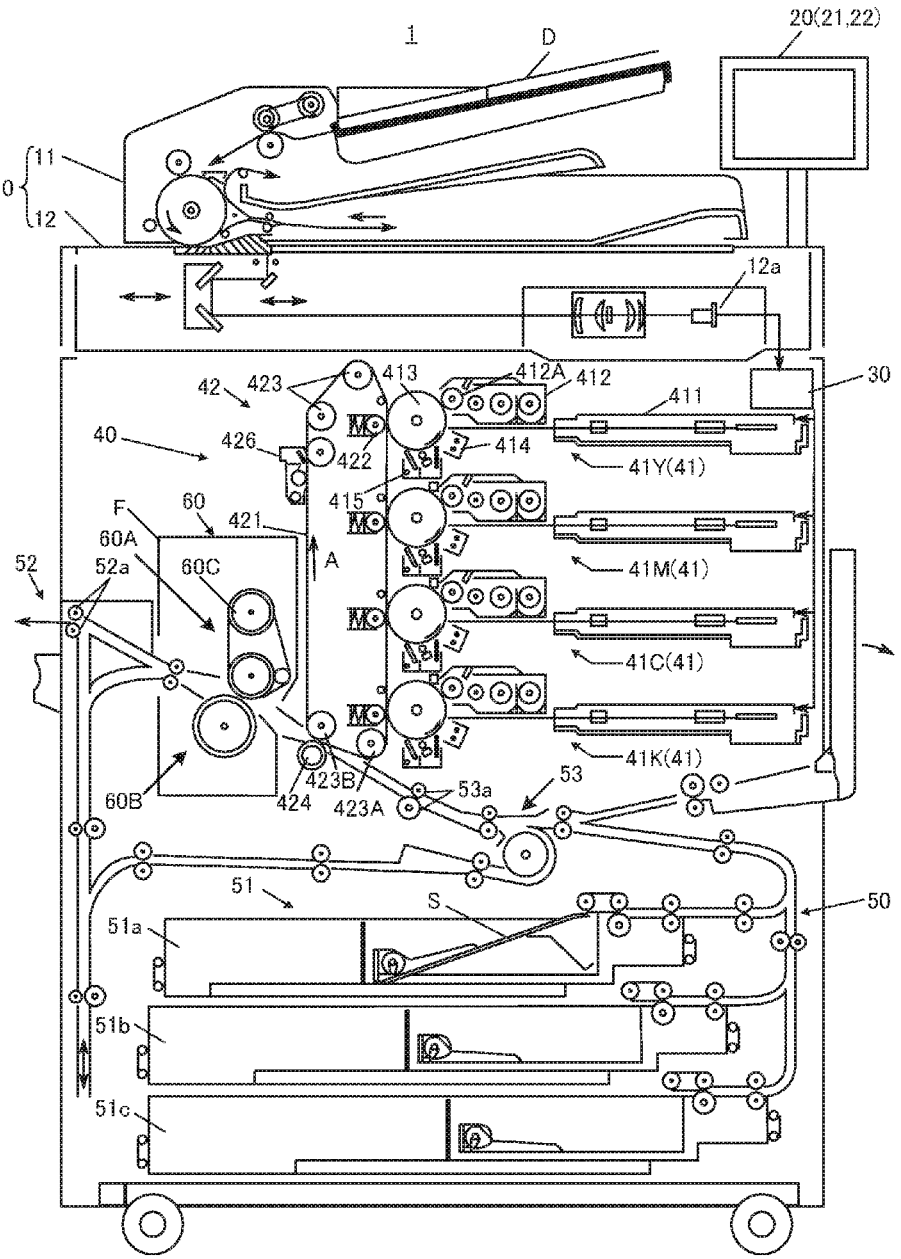
FIG. 1 schematically illustrates a general configuration of an image forming apparatus of an embodiment.
Figure 2:
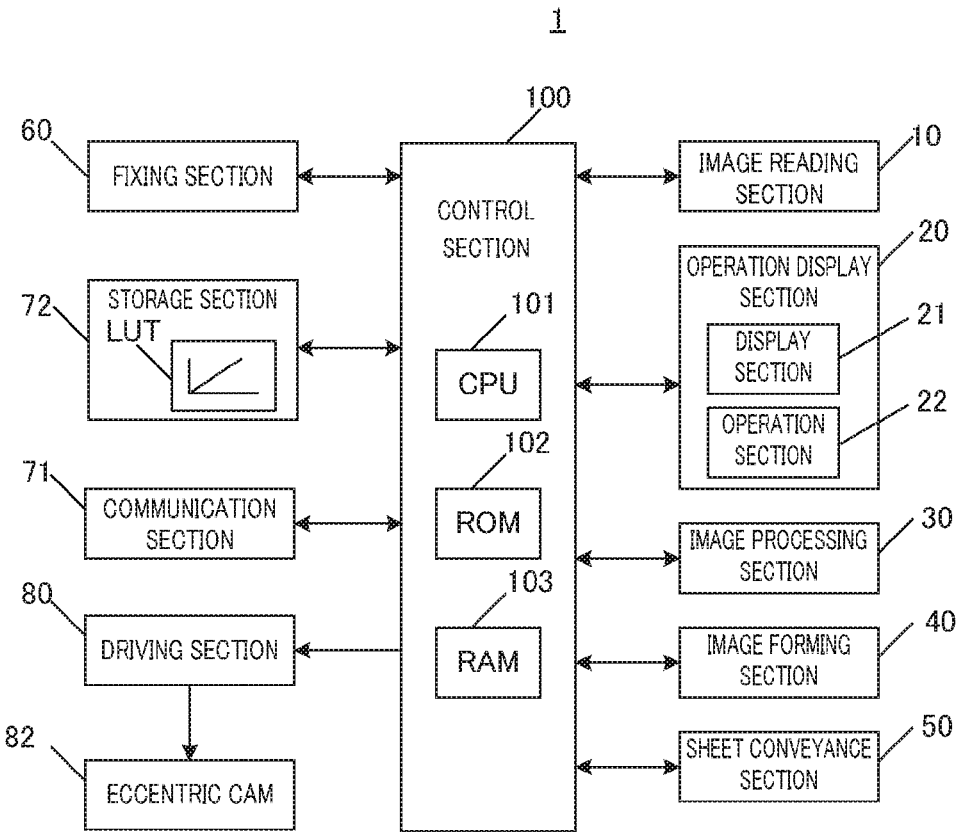
FIG. 2 is a principal part of a control system of the image forming apparatus of the embodiment.

In the following, the present embodiment is described in detail with reference to the drawings. FIG. 1 illustrates an overall configuration of image forming apparatus 1 according to the embodiment of the present invention. FIG. 2 illustrates a principal part of a control system of image forming apparatus 1 according to the embodiment. Image forming apparatus 1 illustrated in FIGS. 1 and 2 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60 and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415, and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 60 mm. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 causes corona discharge to evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component reverse type, and attaches toners of respective color components to the surface of photoconductor drums 413, and visualizes the electrostatic latent image to form a toner image. Developing roller 412A of developing device 412 bears developer while rotating, and supplies the toner contained in the developer to photoconductor drum 413, thereby forming a toner image on the surface of photoconductor drum 413.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt using PI (polyimide) as a base, and is stretched around a plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 log Ω·cm. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of sheet S, lower fixing section 60B having a back side supporting member disposed on the rear surface (the surface opposite to the fixing surface) side of sheet S, heating source 60C, and the like. The back side supporting member is brought into pressure contact with the fixing side member, whereby a fixing nip for conveying sheet S in a tightly sandwiching manner is formed.

At the fixing nip, fixing section 60 applies heat and pressure to sheet S on which a toner image has been secondary-transferred to fix the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Figure 3A:
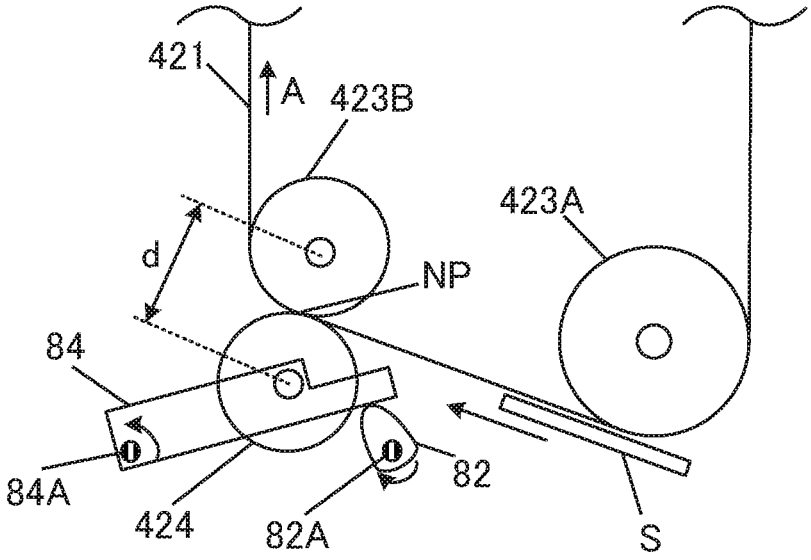
FIGS. 3A and 3B illustrate a configuration for forming a secondary transfer nip.
Figure 3B:
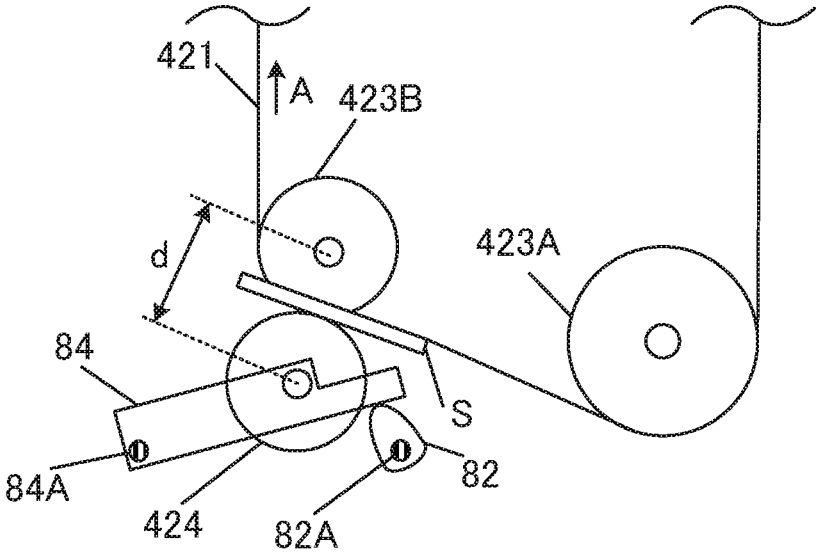

Next, with reference to FIGS. 3A and 3B, a configuration for forming secondary transfer nip NP will be described in detail. As illustrated in FIGS. 3A and 3B, secondary transfer roller 424 (which corresponds to the "second roller" of the embodiment of the present invention) is brought into pressure contact with backup roller 423B (which corresponds to the "first roller" of the embodiment of the present invention) with intermediate transfer belt 421 therebetween, whereby a secondary transfer nip NP for transferring a toner image from intermediate transfer belt 421 to sheet S is formed.

Backup roller 423B is configured as a formed roller, and is an elastic body roller having a mandrel and an elastic layer (which corresponds to the "elastic part" of the embodiment of the present invention) covering the outer periphery of the mandrel, for example. The material of the mandrel is a metal such as aluminum. The material of the elastic layer is polyurethane form having conductivity. Backup roller 423B has a hardness of 80° or smaller in ASKER C hardness.

Secondary transfer roller 424 is composed of a hard roller, and includes a silicone rubber layer having a thickness of 1 mm provided on a metal roller and a surface layer formed of a fluorinated (PFA) tube having a thickness of 30 μm. Secondary transfer roller 424 is rotatably held by holding member 84 composed of a rigid body. At an end portion of holding member 84, eccentric cam 82 is provided such that eccentric cam 82 can be brought into contact with the end portion. Eccentric cam 82 is composed of a rigid body, and is rotated about fulcrum 82A of eccentric cam 82 by driving section 80 which has received a control command from control section 100. When eccentric cam 82 rotates in the clockwise direction in the drawing in a state where eccentric cam 82 is in contact with the end portion of holding member 84, holding member 84 and secondary transfer roller 424 rotates about fulcrum 84A of holding member 84 in the counterclockwise direction in the drawing. Along with the rotation of secondary transfer roller 424, secondary transfer roller 424 is brought into pressure contact with backup roller 423B with intermediate transfer belt 421 therebetween. In the state where eccentric cam 82 is not in contact with the end portion of holding member 84, secondary transfer roller 424 is separated from intermediate transfer belt 421 and, in turn, backup roller 423B.

Before the front end of sheet S enters secondary transfer nip NP, control section 100 controls driving section 80 to bring secondary transfer roller 424 into pressure contact with backup roller 423B (see FIG. 3A). To be more specific, control section 100 controls driving section 80 to turn holding member 424 from a separation position where secondary transfer roller 424 and backup roller 423B are separated from each other to a pressing position where secondary transfer roller 424 presses backup roller 423B such that an elastic part of backup roller 423B is depressed by a predetermined depression amount after secondary transfer roller 424 and backup roller 423B start to make contact with each other.

FIG. 3B illustrates a state where sheet S passes through secondary transfer nip NP, that is, a state in a period until the rear end of sheet S has passed over secondary transfer nip NP after the front end of sheet S has entered secondary transfer nip NP. As illustrated in FIG. 3B, holding member 84 and eccentric cam 82 are each composed of a rigid body, and therefore, at the time when sheet S passes through secondary transfer nip NP, center distance d between secondary transfer roller 424 and backup roller 423B is not changed from the center distance d of the state where the front end of sheet S has not yet entered secondary transfer nip NP (FIG. 3A). The reason for this is that the length corresponding to the thickness of sheet S is absorbed by the elastic part of backup roller 423B. That is, before the front end of sheet S enters secondary transfer nip NP, the depression amount of the elastic part of backup roller 423B depressed by secondary transfer roller 424 is set such that center distance d between secondary transfer roller 424 and backup roller 423B is maintained at the time when sheet S passes through secondary transfer nip NP. The depression amount is set in accordance with the type of sheet S. For example, the greater the thickness and basis weight of sheet S, the greater the depression amount to be set.

In the present embodiment, before the front end of sheet S enters secondary transfer nip NP, control section 100 controls secondary transfer roller 424 to press backup roller 423B such that the elastic part of backup roller 423B is depressed by a predetermined depression amount after a photosensor serving as a contact timing detection section described below detects a contact timing at which secondary transfer roller 424 and backup roller 423B start to make contact with each other.

It is to be noted that the contact timing is changed by expansion of the elastic part of backup roller 423B due to the temperature change in image forming apparatus 1, that is, by change of the outer diameter of backup roller 423B. In addition, the contact timing is also changed by change of the outer diameter of the roller due to the component tolerance of secondary transfer roller 424 and backup roller 423B.

Figure 4A:
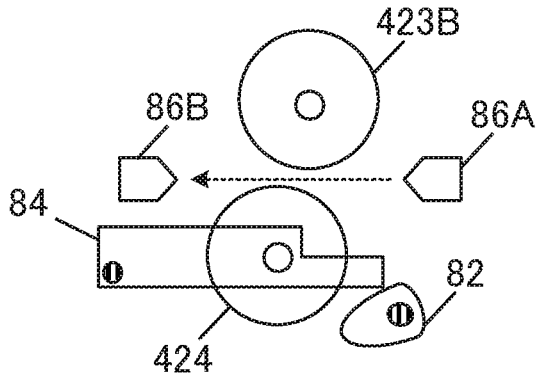
FIGS. 4A and 4B illustrate a configuration of a contact timing detection section of the present embodiment.
Figure 4B:
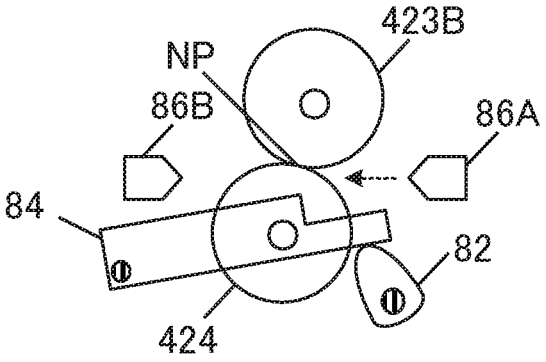

As illustrated in FIGS. 4A and 4B, the contact timing detection section includes light emission section 86A and light reception section 86B. Light emission section 86A is provided on one of the upstream side and the downstream side (for example, the upstream side) of secondary transfer nip NP in the conveyance direction of sheet S, and is configured to emit light toward the other side (for example, the downstream side). Light reception section 86B is provided on the other one of the upstream side and the downstream side (for example, the downstream side) of secondary transfer nip NP in the conveyance direction of sheet S, and is configured to receive the light emitted from light emission section 86A. When secondary transfer roller 424 and backup roller 423B are separated from each other as illustrated in FIG. 4A, light reception section 86B can receive the light emitted from light emission section 86A. When secondary transfer roller 424 and backup roller 423B are not separated from each other as illustrated in FIG. 4B, light reception section 86B cannot receive the light emitted from light emission section 86A. Thus, the contact timing detection section detects, as the contact timing, the timing at which the state of light reception section 86B is changed from a state where the light emitted from light emission section 86A can be received to a state where the light emitted from light emission section 86A cannot be received.

Figure 5:
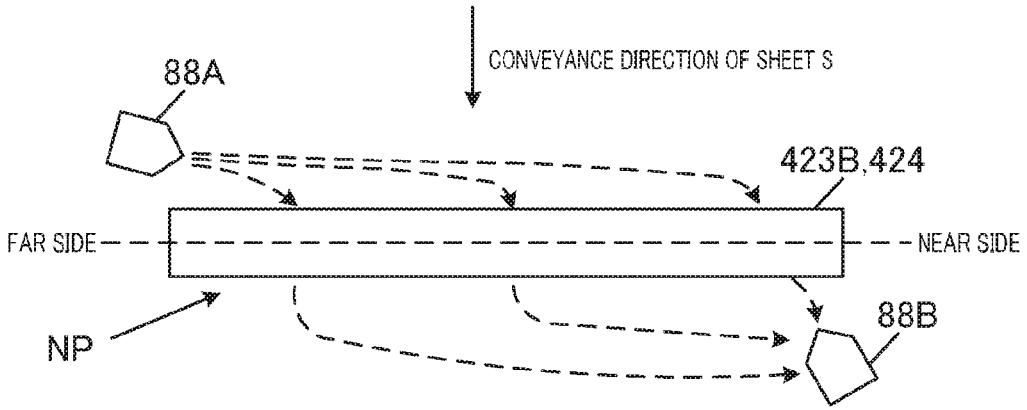
FIG. 5 illustrates a modification of the configuration of the contact timing detection section of the embodiment.

FIG. 5 illustrates a modification of the configuration of the contact timing detection section. FIG. 5 illustrates secondary transfer roller 424 and backup roller 423B as viewed from above. As illustrated in FIG. 5, the contact timing detection section includes air outputting section 88A (for example, a fan) and air flow detection section 88B (for example, an air flow sensor). Air outputting section 88A is provided on one of the upstream side and the downstream side (for example, the upstream side) of secondary transfer nip NP in the conveyance direction of sheet S, and is configured to output air toward the other side (for example, the downstream side). Air flow detection section 88B is provided on the other one of the upstream side and the downstream side (for example, the downstream side) of secondary transfer nip NP in the conveyance direction of sheet S, and is configured to detect the flow rate of the air output from air outputting section 88A. Although not shown in the drawing, when secondary transfer roller 424 and backup roller 423B are separated from each other, air flow detection section 88B can detect the flow rate of the air output from air outputting section 88A. When secondary transfer roller 424 and backup roller 423B are not separated from each other, air flow detection section 88B cannot detect the flow rate of the air output from air outputting section 88A. Thus, the contact timing detection section detects, as the contact timing, the timing at which the state of air flow detection section 88B is changed from a state where the flow rate of the air output from air outputting section 88A can be detected to a state where the flow rate of the air output from air outputting section 88A cannot be detected.

Preferably, air outputting section 88A and air flow detection section 88B are provided on one side (for example, the far side) and the other side (for example, the near side), respectively, in the axis direction of secondary transfer roller 424 and backup roller 423B as illustrated in FIG. 5. In this case, when secondary transfer roller 424 and backup roller 423B are separated from each other, the air output from air outputting section 88A passes through secondary transfer nip NP over the entirety of secondary transfer roller 424 and backup roller 423B in the axis direction of the rollers as illustrated with the dotted arrow in FIG. 5, and then the air is detected by air flow detection section 88B. Thus, the contact timing detection section can accurately detect the contact timing at which secondary transfer roller 424 and backup roller 423B start to make contact with each other over the entirety of secondary transfer roller 424 and backup roller 423B in the axis direction of the rollers.

In FIG. 5, sound generation section 88A and sound detection section 88B may be provided in place of air outputting section 88A and air flow detection section 88B, respectively. That is, the contact timing detection section may include sound generation section 88A (for example, a speaker) and sound detection section 88B. Sound generation section 88A is provided on one of the upstream side and the downstream side (for example, the upstream side) of secondary transfer nip NP in the conveyance direction of sheet S, and is configured to generate sound toward the other side (for example, the downstream side). Sound detection section 88B is provided on the other one of the upstream side and the downstream side (for example, the downstream side) of secondary transfer nip NP in the conveyance direction of sheet S, and is configured to detect the sound generated by sound generation section 88A. Although not shown in the drawing, when secondary transfer roller 424 and backup roller 423B are separated from each other, sound detection section 88B can detect the sound generated by sound generation section 88A. When secondary transfer roller 424 and backup roller 423B are not separated from each other, sound detection section 88B cannot detect the sound generated by sound generation section 88A. Thus, the contact timing detection section detects, as the contact timing, the timing at which the state of sound detection section 88B is changed from a state where the sound generated by sound generation section 88A can be detected to a state where the sound generated by sound generation section 88A cannot be detected. From the viewpoint of accurately detecting the contact timing at which secondary transfer roller 424 and backup roller 423B start to make contact with each other over the entirety of secondary transfer roller 424 and backup roller 423B in the axis direction of the rollers, it is preferable to provide sound generation section 88A and sound detection section 88B on one side (for example, the far side) and the other side (for example, the near side) of secondary transfer roller 424 and backup roller 423B in the axis direction of the rollers, respectively, as illustrated in FIG. 5.

Figure 6:
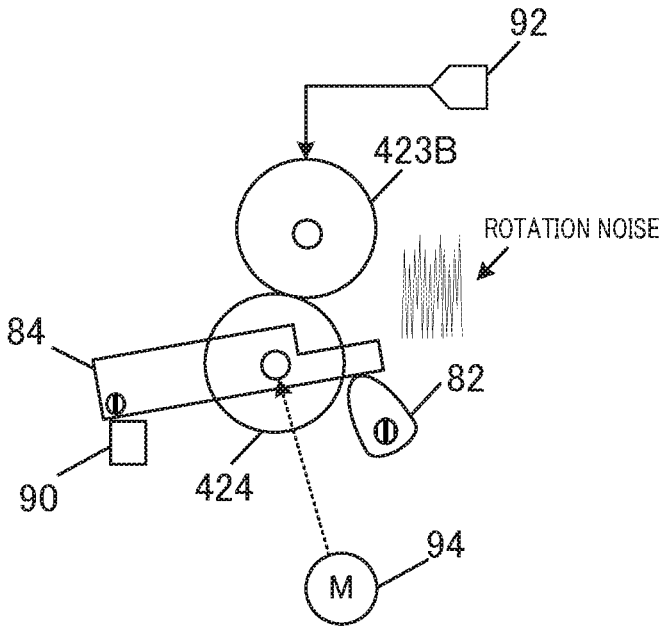
FIG. 6 illustrates a modification of the configuration of the contact timing detection section of the embodiment.

FIG. 6 illustrates a modification of the configuration of the contact timing detection section. As illustrated in FIG. 6, the contact timing detection section includes vibration generation section 90 and vibration detection section 92. Vibration generation section 90 generates forced vibration at one of secondary transfer roller 424 and backup roller 423B (for example, secondary transfer roller 424). Vibration detection section 92 detects the forced vibration that is generated by vibration generation section 90, and is propagated to the other one of secondary transfer roller 424 and backup roller 423B (for example, backup roller 423B) through the contact between secondary transfer roller 424 and backup roller 423B.

Vibration generation section 90 is a piezoelectric element (piezoelectric device) that presses holding member 84, and in turn, secondary transfer roller 424 under the control of control section 100, for example. Forced vibration can be generated at secondary transfer roller 424 by changing the pressing amount on holding member 84. Vibration detection section 92 is an encoder that detects the rotational speed of backup roller 423B. By detecting change of the rotational speed of backup roller 423B, vibration detection section 92 can detect the forced vibration propagated to backup roller 423B through the contact between secondary transfer roller 424 and backup roller 423B. Thus, the contact timing detection section detects, as the contact timing, the timing at which the state of vibration detection section 92 is changed from a state where the forced vibration generated by vibration generation section 90 cannot be detected to a state where the forced vibration generated by vibration generation section 90 can be detected.

In FIG. 6, motor 94 that drives secondary transfer roller 424 into rotation under the control of control section 100 may be provided in place of vibration generation section 90. Motor 94 functions as a rotation noise generation section that generates rotation noise at one of secondary transfer roller 424 and backup roller 423B (for example, secondary transfer roller 424). To be more specific, control section 100 operates to apply to motor 94 a voltage having a direct current component and an alternating current component as a drive voltage for rotating secondary transfer roller 424, thereby generating rotation noise at secondary transfer roller 424 through motor 94. In this case, encoder 92 functions as a rotation noise detection section configured to detect the rotation noise that is generated by the rotation noise generation section (motor 94) and is propagated to backup roller 423B through the contact between secondary transfer roller 424 and backup roller 423B. The contact timing detection section detects, as the contact timing, the timing at which the state of rotation noise detection section 92 is changed from a state where the rotation noise generated by rotation noise generation section 94 cannot be detected to a state where the rotation noise generated by rotation noise generation section 94 can be detected.

It is also possible to generate forced vibration and rotation noise at backup roller 423B instead of secondary transfer roller 424. In this case, when an image is formed on intermediate transfer belt 421 while generating forced vibration and rotation noise at backup roller 423B, the image formation process may be negatively affected by the forced vibration and the rotation noise, and image defect may be caused. Therefore, in the case where forced vibration and rotation noise are generated at backup roller 423B, it is preferable that the frequency of the forced vibration and the rotation noise is a frequency (for example, 1,000 Hz or higher) that does not affect the image formation process.

As has been described in detail, image forming apparatus 1 includes: backup roller 423B having an elastic part; secondary transfer roller 424 configured to form a nip between backup roller 423B and secondary transfer roller 424; holding member 84 configured to hold secondary transfer roller 424; and control section 100 configured to control a position of holding member 84 such that a center distance between backup roller 423B and secondary transfer roller 424 is maintained at a constant value when sheet S passes through the nip. Image forming apparatus 1 further includes driving section 80 configured to move holding member 84 between a separation position at which secondary transfer roller 424 held by holding member 84 is separated from backup roller 423B, and a pressing position at which secondary transfer roller 424 presses backup roller 423B such that the elastic part of backup roller 423B is depressed by a predetermined depression amount after backup roller 423B and secondary transfer roller 424 start to make contact with each other. Control section 100 controls the driving section 80 to control the position of holding member 84.

According to the above-mentioned configuration of the present embodiment, at the time of entering and leaving of the sheet at secondary transfer nip NP, the center distance between secondary transfer roller 424 and backup roller 423B is maintained, that is, the length corresponding to the thickness of sheet S is absorbed by elastic deformation at the elastic part of backup roller 423B, whereby bounding of secondary transfer roller 424 can be prevented. As a result, at the time of entering and leaving of the sheet at secondary transfer nip NP, abrupt increase of the load on the driving source of intermediate transfer belt 421 can be prevented, and in turn, generation of shock jitter due to significant and momentary reduction of the surface movement velocity of intermediate transfer belt 421 can be prevented.

While, in the above-mentioned embodiment, the elastic part of backup roller 423B is depressed by a predetermined depression amount after backup roller 423B and secondary transfer roller 424 start to make contact with each other, the elastic part of backup roller 423B may not necessarily be depressed depending on the type of sheet S (for example, thin paper). Here, it is only necessary that the position of holding member 84 is controlled such that the center distance between backup roller 423B and secondary transfer roller 424 is maintained at a constant value at the time when sheet S passes through the secondary transfer nip. With this configuration, the length corresponding to the thickness of sheet S can be absorbed by elastic deformation at the elastic part of backup roller 423B, and therefore the center distance between backup roller 423B and secondary transfer roller 424 can be maintained at a constant value even when secondary transfer roller 424 is maintained at a certain position. Preferably, in the case where sheet S is thin paper, the depression amount is eliminated or the depression amount is reduced in comparison with the case where sheet S is thick paper, and in the case where sheet S is thick paper, the depression amount is increased in comparison with the case where sheet S is thin paper.

While, in the above-mentioned embodiment, driving section 80 turns holding member 84 between the separation position and the pressing position, driving section 80 may control holding member 84 to move in the vertical direction in FIGS. 3A and 3B between the separation position and the pressing position.

It should be understood by those skilled in the art that various modifications, combinations, sub-combinations and alterations may occur depending on design requirements and other factors in so far as they are within the scope of the appended claims or the equivalents thereof. While the invention made by the present inventor has been specifically described based on the preferred embodiments, it is not intended to limit the present invention to the above-mentioned preferred embodiments but the present invention may be further modified within the scope and spirit of the invention defined by the appended claims.

EXAMPLE

Finally, results of simulations (one inertia model) conducted by the present inventor for confirming the effectiveness of the above-mentioned embodiment will be described.

[Configurations of Image Forming Apparatus According to Example]

As an image forming apparatus according to Example, image forming apparatus 1 having the configuration illustrated in FIGS. 1 to 3 was used.

[Configuration of Image Forming Apparatus According to Comparative Example]

Figure 7A:
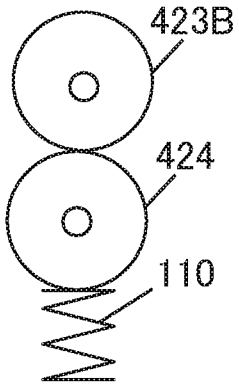
FIGS. 7A and 7B illustrate a configuration of Comparative example.

As an image forming apparatus according to Comparative example, image forming apparatus 1 having the configuration illustrated in FIGS. 1 and 2 was used. It should be noted that the configuration for forming secondary transfer nip NP was different from Example, and a mechanism in which secondary transfer nip NP is formed with the spring load was employed. To be more specific, as illustrated in FIG. 7A, secondary transfer roller 424 was set to be brought into pressure contact with backup roller 423B by pressing spring 110. Further, for the purpose of minimizing variation of the spring load due to displacement of pressing spring 110 at the time of entering and leaving of the sheet at secondary transfer nip NP, the elasticity coefficient (difficulty of deformation) of pressing spring 110 was set to a significantly small value.

[Details of Simulations]

Figure 8A:
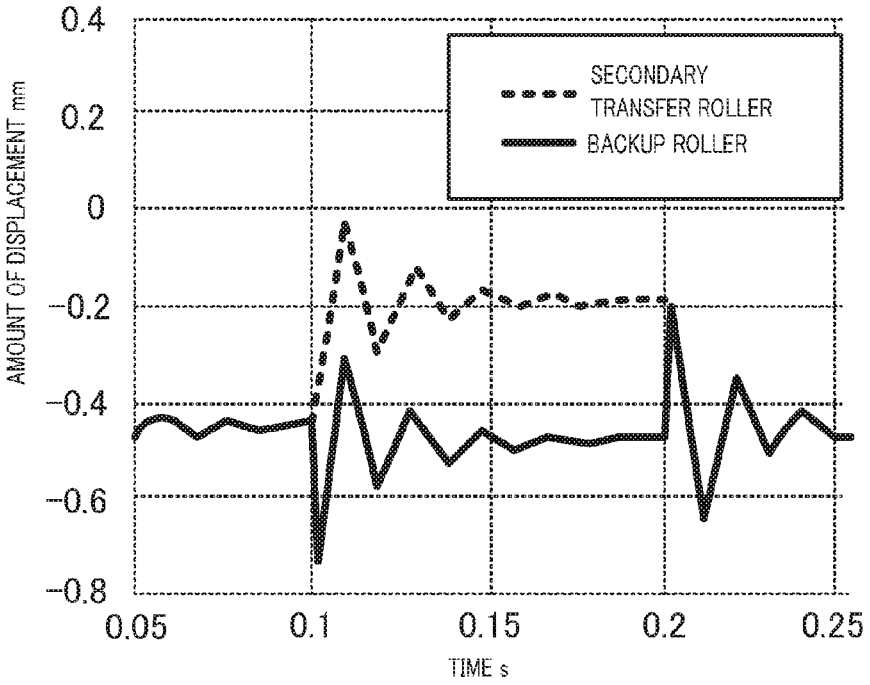
FIGS. 8A and 8B show results of simulation for confirming the effect of the embodiment.
Figure 8B:
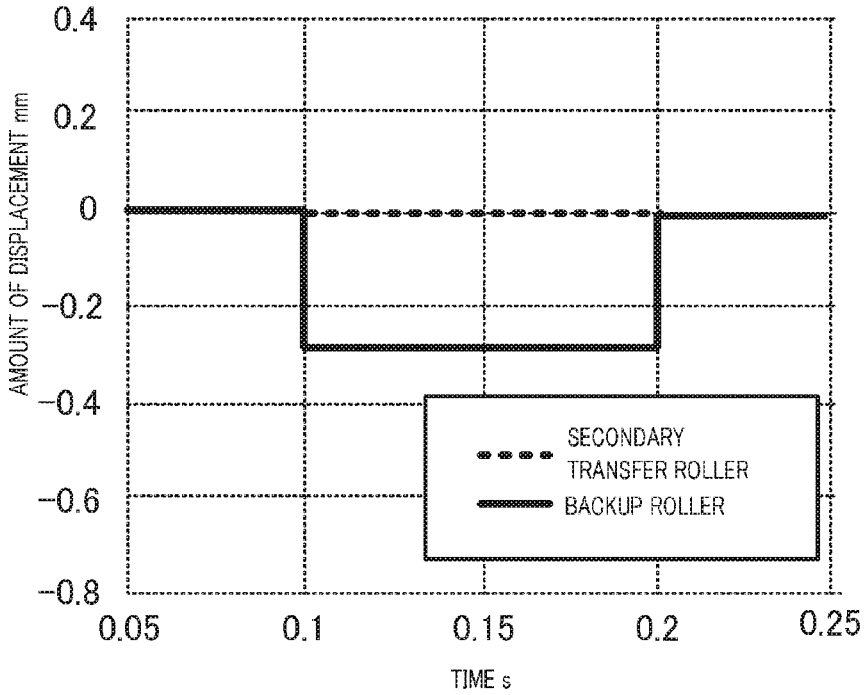
Figure 9A:
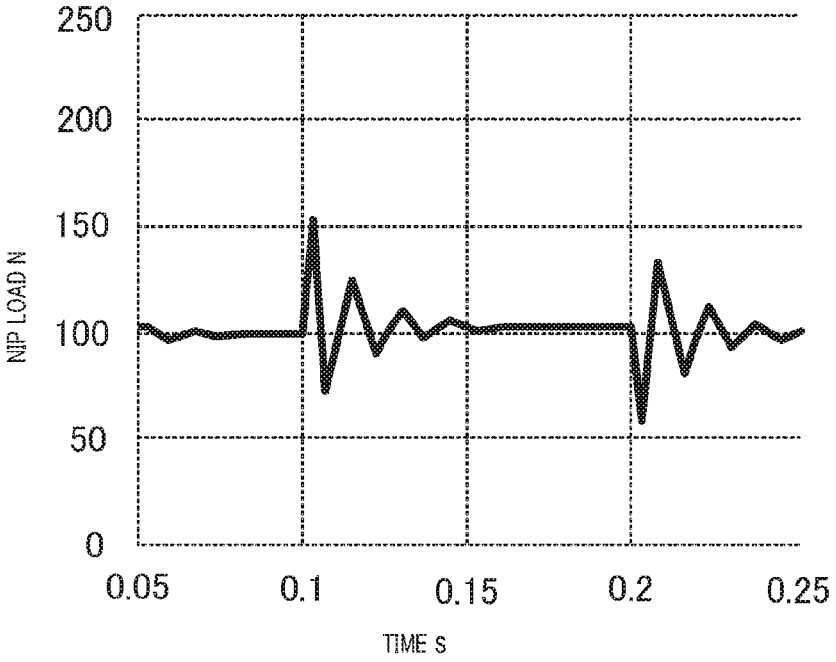
FIGS. 9A and 9B show results of simulation for confirming the effect of the embodiment.
Figure 9B:
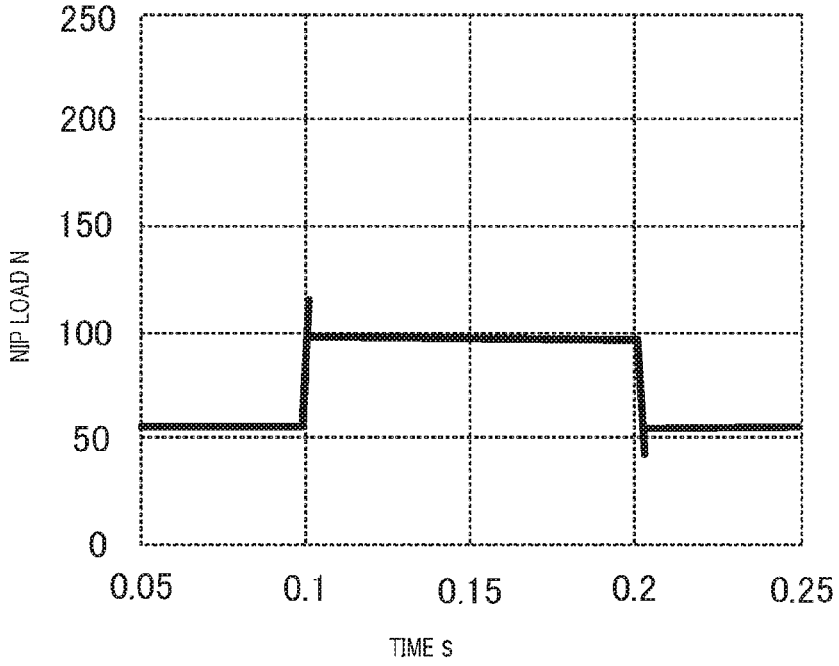

In the simulation, the variation of the amount of displacement of secondary transfer roller 424 and backup roller 423B, and the variation of the nip load of secondary transfer nip NP at the time of entering and leaving of the sheet at secondary transfer nip NP were confirmed. FIG. 8A shows variation of the amount of displacement of secondary transfer roller 424 and backup roller 423B in Comparative example. FIG. 8B shows variation of the amount of displacement of secondary transfer roller 424 and backup roller 423B in Example. FIG. 9A shows variation of nip load in Comparative example. FIG. 9B shows variation of nip load in Example. In FIGS. 8A to 9B, time: 0.1 s is a timing at which the front end of sheet S enters secondary transfer nip NP. Meanwhile, time: 0.2 s is a timing at which the rear end of sheet S leaves secondary transfer nip NP.

[Results of Simulations]

Figure 7B:
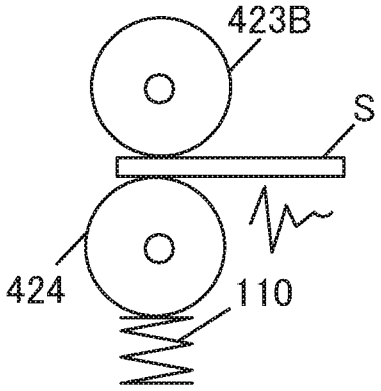

In Comparative example, as illustrated in FIG. 8A, it was confirmed that both of secondary transfer roller 424 and backup roller 423B tend to bound at the time of entering and leaving of the sheet at secondary transfer nip NP. In this case, as illustrated in FIG. 7B, when sheet S passes through secondary transfer nip NP, the center distance between secondary transfer roller 424 and backup roller 423B is changed. When secondary transfer roller 424 bounds, sudden load variation may be caused at the driving source of intermediate transfer belt 421, and shock jitter may be generated due to momentary decrease of the surface movement velocity of intermediate transfer belt 421. In Example, as illustrated in FIG. 8B, the tendency of bounding of secondary transfer roller 424 and backup roller 423B was not confirmed at the time of entering and leaving of the sheet at secondary transfer nip NP, and only the recession of the elastic part of backup roller 423B was confirmed.

In Comparative example, as illustrated in FIG. 9A, as with the amount of displacement of secondary transfer roller 424 and backup roller 423B, tendency of bounding of the nip load was confirmed at the time of entering and leaving of the sheet at secondary transfer nip NP. The bounding of the nip load propagates to intermediate transfer belt 421, and causes unnecessary variation of the surface movement velocity of intermediate transfer belt 421. In Example, as illustrated in FIG. 9B, the tendency of bounding of the nip load was not confirmed at the time of entering and leaving of the sheet at secondary transfer nip NP.

Figure 10:
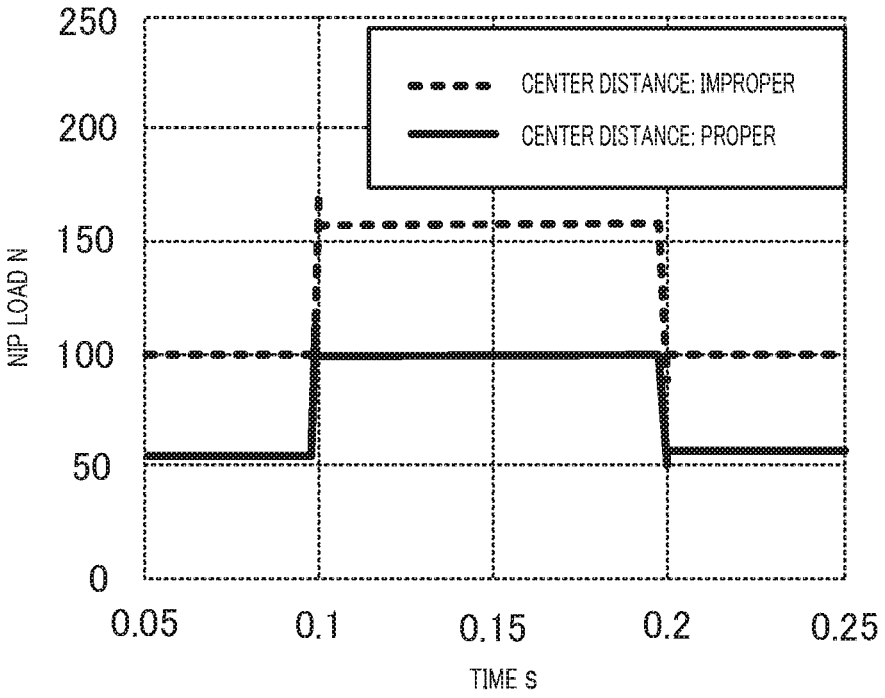
FIG. 10 illustrates variation of nip load according to variation of a center distance.

FIG. 10 shows variation of the nip load of secondary transfer nip NP of a case where the center distance between secondary transfer roller 424 and backup roller 423B is set to a proper distance (that is, the pressing amount of secondary transfer roller 424 on backup roller 423B is a proper amount), and a case where the center distance is not set to a proper distance in the configuration of Example. Here, the state where the center distance between secondary transfer roller 424 and backup roller 423B is not set to a proper distance means that the center distance between secondary transfer roller 424 and backup roller 423B is set to a distance different from a proper distance by 0.3 mm, which corresponds to the thickness of thick paper. As illustrated in FIG.

10, although the tendency of the bounding of the nip load was not confirmed, the nip load was greater than 150 N at the time of entering and leaving of the sheet at secondary transfer nip NP, which may cause transfer defect and conveyance defect of sheet S. In this manner, the importance of setting the center distance between secondary transfer roller 424 and backup roller 423B to a proper distance was confirmed. With the results of the simulations, the effectiveness of the above-mentioned embodiment was confirmed.

What is claimed is:

1. An image forming apparatus comprising:

a first roller having an elastic part;

a second roller configured to form a nip between the first roller and the second roller;

a holder configured to hold the second roller; and a controller configured to control a position of the holder such that a center distance between the first roller and the second roller is set and maintained at a constant value when a sheet passes through the nip;

a contact timing detector configured to detect a contact timing at which the first roller and the second roller start to make contact with each other; and the controller being configured to control the position of the holder so that the holder moves between a separation position at which the second roller held by the holder is separated from the first roller, and a pressing position at which the second roller presses the first roller such that the elastic part of the first roller is depressed by a predetermined depression amount after the contact timing detector detects the contact timing at which the first roller and the second roller start to make contact with each other.

2. The image forming apparatus according to claim 1, wherein the contact timing detector includes:

a light emitter provided on one of an upstream side and a downstream side of the nip in a sheet conveyance direction, and configured to emit light toward the other one of the upstream side and the downstream side; and a light receptor provided on the other one of the upstream side and the downstream side of the nip in the sheet conveyance direction, and configured to receive light emitted from the light emitter, and the contact timing detector detects the contact timing on a basis of a result of light reception of the light receptor.

3. The image forming apparatus according to claim 1, wherein the contact timing detector includes:

an air outputting section provided on one of an upstream side and a downstream side of the nip in a sheet conveyance direction, and configured to output air toward the other one of the upstream side and the downstream side; and an air flow detection section provided on the other one of the upstream side and the downstream side of the nip in the sheet conveyance direction, and configured to detect a flow rate of air output from the air outputting section, and the contact timing detector detects the contact timing on a basis of a result of detection of the air flow detection section.

4. The image forming apparatus according to claim 3, wherein the air outputting section and the air flow detection section are provided on one side and the other side, respectively, in an axis direction of the first roller and the second roller.

5. The image forming apparatus according to claim 1, wherein the contact timing detector includes:

a sound generation section provided on one of an upstream side and a downstream side of the nip in a sheet conveyance direction, and configured to generate sound toward the other one of the upstream side and the downstream side; and a sound detection section provided on the other one of the upstream side and the downstream side of the nip in the sheet conveyance direction, and configured to detect the sound generated by the sound generation section, and the contact timing detector detects the contact timing on a basis of a result of detection of the sound detection section.

6. The image forming apparatus according to claim 5, wherein the sound generation section and the sound detection section are provided on one side and the other side, respectively, in an axis direction of the first roller and the second roller.

7. The image forming apparatus according to claim 1, wherein the contact timing detector includes:

a vibration generation section configured to generate forced vibration at one of the first roller and the second roller; and a vibration detection section configured to detect the forced vibration which is generated by the vibration generation section and propagated to the other one of the first roller and the second roller through contact between the first roller and the second roller, and the contact timing detector detects the contact timing on a basis of a result of detection of the vibration detection section.

8. The image forming apparatus according to claim 7, wherein the vibration generation section generates vibration having a frequency which does not affect an image formation process.

9. The image forming apparatus according to claim 1, wherein the contact timing detector includes:

a rotation noise generation section configured to generate rotation noise at one of the first roller and the second roller; and a rotation noise detection section configured to detect the rotation noise which is generated by the rotation noise generation section and propagated to the other one of the first roller and the second roller through contact between the first roller and the second roller, and the contact timing detector detects the contact timing on a basis of a result of detection of the rotation noise detection section.

10. The image forming apparatus according to claim 9, wherein the rotation noise generation section generates rotation noise having a frequency which does not affect an image formation process.

11. The image forming apparatus according to claim 1, wherein the elastic part has a hardness of 80° or smaller in ASKER C hardness.

12. The image forming apparatus according to claim 1, further comprising an eccentric cam positioned to contact the holder, the eccentric cam being configured to move the holder between the separation position and the pressing position.

* * * * *